US005141458A

United States Patent [19]

Church

[11] Patent Number: 5,141,458

[45] Date of Patent: Aug. 25, 1992

[54] MARKER BUOY

[75] Inventor: John D. Church, Auckland, New Zealand

[73] Assignee: Seaka Products Limited, Auckland, New Zealand

[21] Appl. No.: 671,395

[22] Filed: Mar. 19, 1991

[30] Foreign Application Priority Data

Mar. 20, 1990 [NZ] New Zealand ..... 232991

[51] Int. Cl.[5] ..... B63B 22/18

[52] U.S. Cl. ..... 441/26; 441/30

[58] Field of Search ..... 441/1, 6, 10, 21, 30, 441/32, 33

[56] References Cited

U.S. PATENT DOCUMENTS

| | | | |
|---|---|---|---|
| 3,149,352 | 9/1964 | Christiansen | 441/30 X |
| 3,667,417 | 6/1972 | Clinkenbeard | 441/30 X |
| 3,702,014 | 11/1972 | Rabon et al. | 441/6 |
| 3,992,736 | 11/1976 | Reed, 3rd et al. | 441/30 |
| 4,673,363 | 6/1987 | Hudson et al. | 441/1 |

*Primary Examiner*—Edwin L. Swinehart

*Attorney, Agent, or Firm*—Harness, Dickey & Pierce

[57] ABSTRACT

A marker buoy, typically for use by divers, includes a lighter-than-water flotation component, such as a bladder (17) which can be inflated when the buoy is required to float and deflated when it is not required to float, so that the diver can easily dive with the deflated buoy and inflate it at depth, when required. A reel (19) of line (25) carried by the buoy is arranged to dispense the line therefrom when the tension in the line exceeds a chosen value.

7 Claims, 2 Drawing Sheets

MARKER BUOY

BACKGROUND OF THE INVENTION

This invention relates to a marker buoy, and is applicable particularly, but not exclusively, to a buoy for use by divers to mark the position of themselves when they are submerged or of some submerged object or of a diving location.

BRIEF SUMMARY OF THE INVENTION

According to one aspect of the invention, there is provided a marker buoy, including a lighter-than-water flotation component which is optionally inflatable when the buoy is required to float and is optionally deflatable when the buoy is not required to float.

Preferably the buoy includes valve means through which air can be forced to inflate said component the valve means being automatically closable. For this purpose, the valve means may include a closure member which closes when the buoy is in a normal orientation and which opens when the buoy is inverted from said normal orientation.

Conveniently, the buoy includes a weight carried by the flotation component, the weight being located so as to urge the buoy into said normal orientation when in use.

Advantageously, the weight is movable between a first position when the buoy is in the normal orientation and a second position when the buoy is in the invented orientation, and in said first position the weight bears against said closure member to assist closing of the valve means.

According to another aspect of the present invention, there is provided a marker buoy, including a lighter-than-water flotation component and a reel of line carried on the buoy, the reel being adapted to dispense the line therefrom only when tension in the line exceeds a predetermined value.

Preferably, the axis of the reel is disposed substantially vertically, when the buoy is in use, and the line is dispensed by sliding over a bottom flange of the reel, through the nip formed by a member spring loaded against said flange.

The bottom flange may be substantially frustro-conical in form.

Conveniently, where, in use, the tensioned line departs from the marker buoy at a point away from said substantially vertical axis, the weight or a further weight is carried by the buoy at a low location thereon with the centre of gravity of said weight displaced from said axis on the same side thereof as said point of line departure, whereby the tilting moment due to the offset line tension is at least partly balanced by the tilting moment due to the offset weight.

The further weight may be optionally detachable from the buoy and clippable to the free end of said line and may be heavy enough to exert a tension in the line in excess of said predetermined value.

BRIEF DESCRIPTION OF THE DRAWINGS

Various embodiments of the invention are described, by way of example only, with reference to the accompanying drawings, in which.

DETAILED DESCRIPTION

Figure 1:
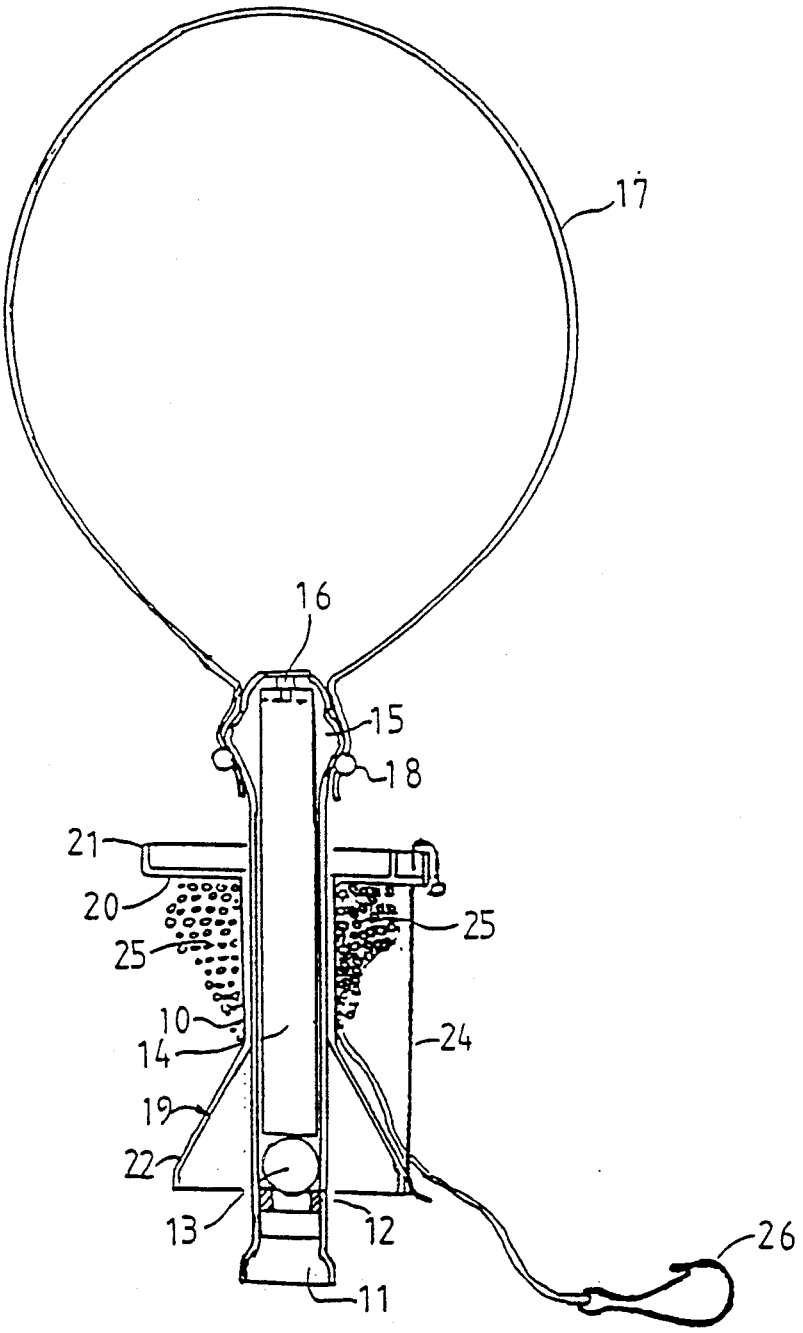
FIG. 1 is a section in a central vertical plane through a marker buoy, according to the invention.

In the drawings, a marker buoy includes a central plastics tube 10 within the bottom end of which a piece of similar plastics tube 11 is fastened by adhesive. The lower end of the tube 11 is somewhat flattened to form a mouth-piece. A rubber ring 12 is a tight fit within the tube 10 and abuts the upper end of the mouth-piece 11.

In the upright position of the buoy, shown in FIG. 1, the central hole through the ring 12 is closed by a ball 13, conveniently of stainless steel. When the buoy is inverted, the ball 13 drops away from the ring 12 to allow air to pass therethrough. Thus, the ring 12 and ball 13 constitute an air valve. Closure of the air valve is enhanced by a cylindrical lead weight 14, freely slidable within the tube 10. The weight 14 rests on the ball 13, when the buoy is upright. The upper end of the tube 10 is formed with an external annular bulge 15 and has an inwardly crimped end 16, to retain the weight 14 whilst allowing air to pass therethrough.

A flexible collapsible bladder 17 of rubber or similar elastomeric material is affixed on the upper end of the tube 10. The neck of the bladder is pulled over the annular bulge 15 and retain there by an O-ring 18.

Around the tube 10 and fastened co-axially thereon is a reel 19 having an upper flange 20 in the form of a flat disc with an upturned rim 21. The reel 17 has a frusto-conical lower flange 22. A springy stainless steel wire clip 24 fastened in a thickened part of the rim 21 of the upper flange 20, bears against the lower part of the lower flange 22. A nylon line 25, of suitable length is wound around the reel 19 and has a suitable spring clip 26 fastened to the end thereof.

A generally downward pull on the line 25 will cause it to unwind from the reel 19 by running around the lower flange 22. However, this unwinding is inhibited by the spring clip 24, until there is sufficient tension in the line 25 for it to pull through the nip between the lower flange 22 and the clip 24.

In a typical method of using the marker buoy described above, a diver packs the buoy into a compact form by folding the deflated bladder 17 around the reel 19 and wrapping a few turns of the line 25 around the assembly. The clip 26 can be attached to some part of the diver's gear while he dives. On finding an object or location which the diver wishes to locate by means of the marker buoy, he attaches the line 25 to the object, making use of the clip 26 as appropriate. He then unwinds the line 25 from around the bladder 17, inverts the tube 10 so that the ball 13 and weight 14 fall away from the ring 12, and blows air through the mouth-piece 11, to inflate the bladder 17. When adequately inflated, the diver inverts the tube 10, so that the mouth-piece 11 is at the bottom, whereupon the ball 13 seals the ring 12, to retain the air within the bladder 17.

When the marker buoy is released, the buoyancy of the inflated bladder 17 causes the buoy to rise, the tension in the line 25 being adequate to cause the line 25 to pass through the nip between the clip 24 and lower flange 22, so that the buoy ascends to the surface of the water.

Figure 2:
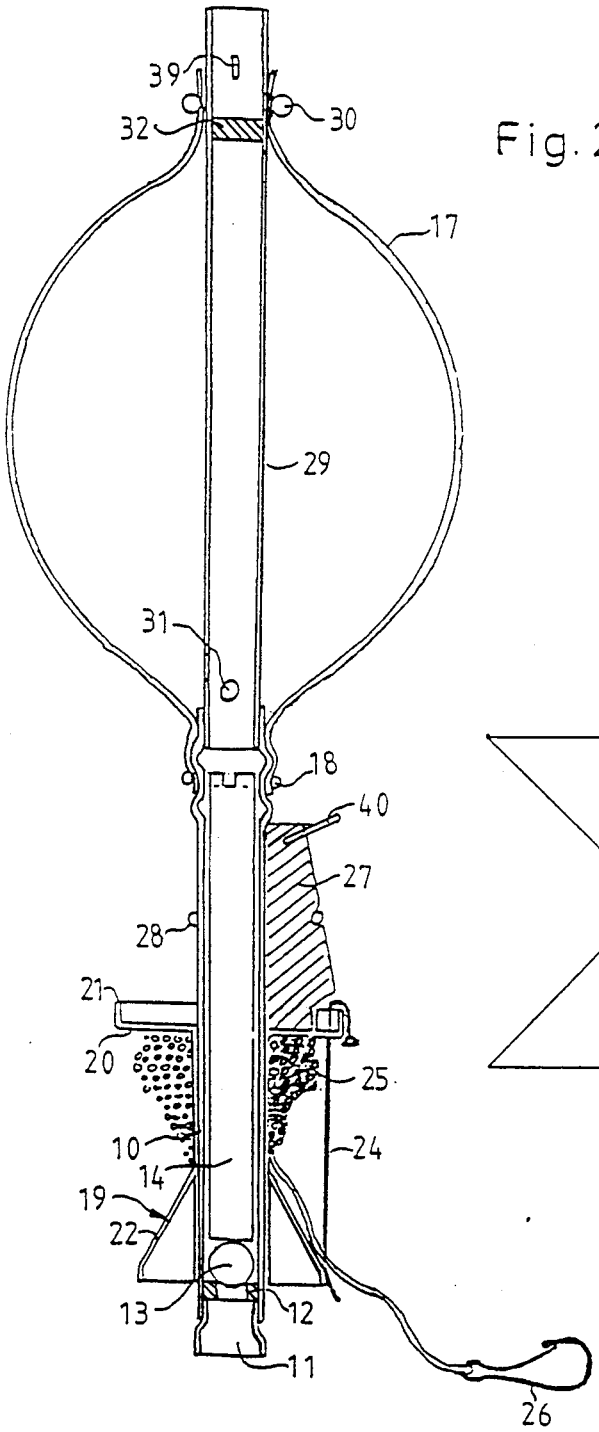
FIG. 2 is a section in a vertical plane through an alternative marker buoy to FIG. 1.
Figure 3:
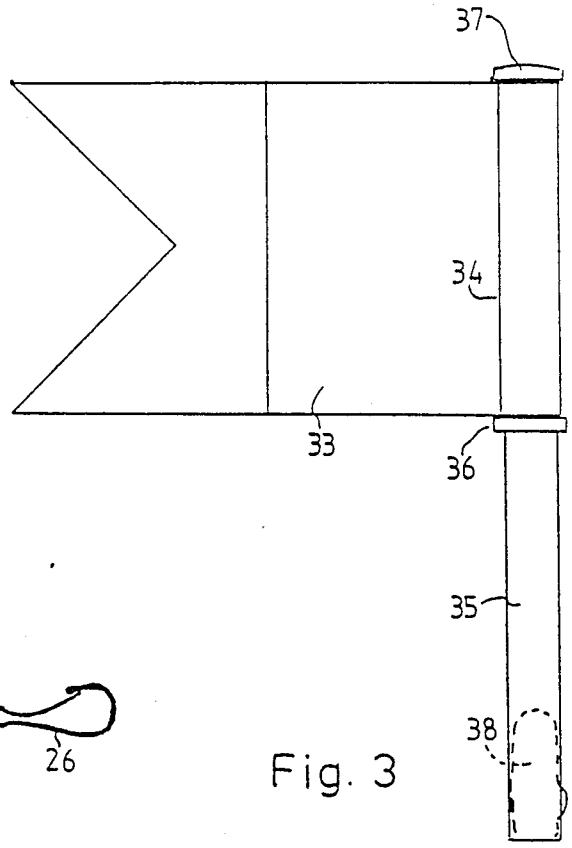
FIG. 3 shows a further component of the buoy shown in FIG. 2.

FIG. 2 shows a marker buoy having many features in common with FIG. 1. It will be seen that the tube 10 is longer, above the level of the reel flange 20, so that a further weight 27 preferably made of antimony lead can stand on the flange 20, being located radially by the rim 21 and circumferently by fitting against the thicker part of the rim 21 adjacent the clip 24. The weight 27 is held to the tube 10 removably by a rubber O-ring 28. It will be seen that the weight 27 is offset from the central vertical axis of the buoy in the same direction as the clip 24.

The top end of the tube 10 has the lower end of a further tube 29 glued therein, the further tube 29 passing right through the bladder 17 and being sealed thereto at the upper end by an O-ring 30. Holes 31 through the tube 29 allow air to pass into and out of the bladder 17, whilst a rubber bung 32 prevents air escaping through the top of the tube 29.

FIG. 4 shows a diver's safety flag, to indicate the presence of a diver, having a blue and white nylon or polyester body 33 formed as a sleeve 34 at the right hand end, the sleeve 34 being a loose fit on a tubular plastics stem 35. The flag body 33 is retained axially between a plastics ring on the stem 35 and a plug 37 in the end thereof. The lower end of the stem 35 can be pushed into the upper end of the tube 29 and retained there by a wire clip 38 which engages in a slot 39 in the tube 29.

In the normal use of this type of marker buoy, the diver inflates the bladder 17 before he enters the water, he attaches the clip 29 to himself, throws the marker buoy into the water and the diver then dives. As he descends, the tension in the line 25 causes it to be pulled off the reel 19, the marker buoy remaining at the surface of the water. As the diver moves around horizontally, the marker buoy is towed along with him, by the line 25. The tension in the line 25 tends to tilt the marker buoy so that the flag 33 at the top thereof is no longer upright. However, this tendency is offset, to some extent, by the moment generated by the lead weight 27 being offset from the vertical axis of the buoy.

In another mode of use of this marker buoy, the lead weight 27 can be detached from the buoy and the clip 26 attached to a loop 40 on the weight 27, which can then be thrown into the water, the weight being adequate to pull the line 25 off the reel 19 until the weight 27 reaches the bottom. Thus, the marker buoy can be used to mark a diving location or an object on the bottom.

The marker buoys described above have high visibility when in use.

I claim:

1. A marker buoy including a lighter-than-water floatation component which is inflatable when the buoy is required to float and is deflatable when the buoy is not required to float, including valve means through which air can be forced to inflate said component, the valve means being automatically closable, and in which the valve means includes a closure member which closes in response to placing the buoy in a normal orientation and which opens in response to inverting the buoy from said normal orientation, the marker buoy further including a weight carried by the floatation component, the weight being located so as to urge the buoy into said normal orientation when in use.

2. A market buoy, as in claim 1, in which the weight is movable between a first position when the buoy is in the normal orientation and a second position when the buoy is in the inverted orientation, and in said first position the weight bears against said closure member to assist closing of the valve means.

3. A marker buoy, as in claim 1 including a reel of line carried on the buoy, the reel being adapted to dispense the line therefrom only when tension in the line exceeds a predetermined value, and in which the axis of the reel is disposed substantially vertically, when the buoy is in use, and the line is dispensed by sliding over a bottom flange of the reel, through a nip formed by a spring member loaded against said flange.

4. A market buoy, as in claim 3, in which the bottom flange is substantially frustro-conical in form.

5. A marker buoy, as in claim 3 in which, in use, the line, when tensioned, departs from the marker buoy at a point away from said substantially vertical axis, and means for offsetting the center of gravity of the buoy from said axis on the same side thereof as said point of line departure, whereby the tilting moment due to the offset line tension is at least partly balanced by the tilting moment due to the offset center of gravity.

6. The marker buoy of claim 5 wherein the center of gravity is ofset by an offset weight carried by the buoy at a low location thereon with the center of gravity of the offset weight displaced from the axis on the same side thereon as said point of line departure.

7. A marker buoy, as in claim 6, in which the offset weight is optionally detachable from the buoy and clippable to a free end of said line and is heavy enough to exert a tension in the line in excess of said predetermined value.

* * * * *